US011198131B2

(12) United States Patent
Mayer et al.

(10) Patent No.: US 11,198,131 B2
(45) Date of Patent: Dec. 14, 2021

(54) STRIKING TOOL AND ROTOR FITTED THEREWITH FOR A MACHINE FOR CRUSHING METAL OBJECTS OR STONE MATERIALS

(71) Applicant: Stahlwerke Bochum GmbH, Bochum (DE)

(72) Inventors: Bruno Mayer, Bochum (DE); Stephan O. Mayer, Duisburg (DE)

(73) Assignee: Stahlwerke Bochum GmbH, Bochum (DE)

( * ) Notice: Subject to any disclaimer, the term of this patent is extended or adjusted under 35 U.S.C. 154(b) by 0 days.

(21) Appl. No.: 17/048,189

(22) PCT Filed: Apr. 18, 2018

(86) PCT No.: PCT/EP2018/059910
§ 371 (c)(1),
(2) Date: Oct. 16, 2020

(87) PCT Pub. No.: WO2019/201437
PCT Pub. Date: Oct. 24, 2019

(65) Prior Publication Data

US 2021/0162422 A1 Jun. 3, 2021

(51) Int. Cl.
*B02C 13/28* (2006.01)

(52) U.S. Cl.
CPC ..... *B02C 13/28* (2013.01)

(58) Field of Classification Search
CPC ..... B02C 13/28
See application file for complete search history.

(56) References Cited

U.S. PATENT DOCUMENTS 2,240,404 A * 4/1941 King ..... B02C 13/28 241/197
4,310,125 A * 1/1982 Novotny ..... B02C 13/28 241/195

(Continued)

FOREIGN PATENT DOCUMENTS

CN 204891933 U 12/2015
EP 1047499 B1 4/2003

(Continued)

OTHER PUBLICATIONS

"Stahlwerke Bochum—Hochverschleißfeste Gußteile", 2012, pp. 1-9. (Relevant for reasons stated in IPRP).

*Primary Examiner* — Faye Francis
(74) *Attorney, Agent, or Firm* — The Webb Law Firm

(57) ABSTRACT

A striking tool for crushing metal or stone materials, where the striking tool is manufactured from an iron-based material and includes a bearing section, into which a bearing opening is formed around a pivot axis and includes a striking section which is exposed to a striking load by contact with the material to be crushed, and a rotor equipped therewith for a machine to crush metal or stone materials. The striking tool improves with the ability of its bearing section to absorb the dynamic loads acting on the striking tool. The bearing opening has a support section, on whose inner circumferential surface the striking tool is mounted for its swing movement around the pivot axis and has an extension section, which is connected to the support section and the bearing opening is extended in the direction of the striking section with respect to the support section.

11 Claims, 3 Drawing Sheets

(56) References Cited

U.S. PATENT DOCUMENTS

| | | | | |
|---|---|---|---|---|
| 7,419,109 | B1 * | 9/2008 | Ronfeldt | B02C 13/28 241/189.1 |
| 7,757,979 | B2 * | 7/2010 | Stelk | B02C 13/28 241/25 |
| 8,342,435 | B2 * | 1/2013 | Plumb | B02C 13/28 241/195 |
| 9,737,894 | B1 * | 8/2017 | Young | B21K 5/00 |
| 9,855,560 | B2 * | 1/2018 | Graf | B02C 13/284 |
| 10,022,724 | B2 * | 7/2018 | Weeks | B02C 13/00 |
| 10,507,468 | B2 * | 12/2019 | Young | B23K 9/23 |
| 2006/0032958 | A1 * | 2/2006 | Young | B02C 13/28 241/194 |
| 2006/0226269 | A1 * | 10/2006 | Stelk | B02C 13/28 241/194 |
| 2009/0224090 | A1 * | 9/2009 | Young | B02C 13/04 241/195 |
| 2009/0250539 | A1 * | 10/2009 | Stelk | B02C 13/28 241/197 |
| 2011/0042498 | A1 | 2/2011 | Young et al. | |
| 2014/0191070 | A1 * | 7/2014 | Young | B21K 5/00 241/195 |
| 2014/0353413 | A1 * | 12/2014 | Plumb | B02C 13/28 241/194 |
| 2015/0314298 | A1 * | 11/2015 | Porter | B02C 13/04 241/197 |
| 2017/0291175 | A1 | 10/2017 | Plumb | |
| 2018/0085758 | A1 * | 3/2018 | Graf | B02C 13/04 |

FOREIGN PATENT DOCUMENTS

| | | | |
|---|---|---|---|
| JP | S4991879 | U | 8/1974 |
| JP | S60197247 | A | 10/1985 |
| JP | 2017154083 | A | 9/2017 |
| WO | 9705951 | A1 | 2/1997 |

* cited by examiner

STRIKING TOOL AND ROTOR FITTED THEREWITH FOR A MACHINE FOR CRUSHING METAL OBJECTS OR STONE MATERIALS

CROSS-REFERENCE TO RELATED APPLICATION

This application is the United States national phase of International Application No. PCT/EP2018/059910 filed Apr. 18, 2018, the disclosure of which is hereby incorporated by reference in its entirety.

BACKGROUND OF THE INVENTION

Field of the Invention

The invention relates to a striking tool for crushing metal objects or stone materials.

Description of Related Art

Such striking tools are also called striking hammers and are typically used in machines to crush metal scrap, such as bodies of vehicles intended for scrap, or demolition or construction waste.

The striking tools of the type mentioned here, which are usually cast in one piece from an iron-based material from a cast metal material or, alternatively, manufactured by forging or flame cutting a correspondingly formed primary product or as a weld construction, comprise a bearing section in which a bearing opening is formed with a cylindrically shaped inner circumferential surface and comprise a striking section, which is exposed during use to a striking load by contact with the material to be crushed. During use a metallic shaft is pushed through the opening the striking tool being mounted on the shaft in a swinging manner such that there is metallic frictional contact between the outer circumferential surface of the shaft and the inner circumferential surface of the bearing opening of the striking tool.

Examples of such striking tools are described in WO 97/05951 A1 and the brochure "Stahlwerke Bochum—Hochverschleißfeste Gußteile", from 2012, published by the applicant and available for download following the URL http://stahlwerke-bochum.com/wp-content/uploads/2015/07/swb_image_prospekt_d.pdf.

An example of a rotor for a crushing machine which can be fitted with the striking tools of the type considered here, is represented in EP 1 047 499 B1.

Such rotors rotate during use around an axis of rotation and have on their circumference a plurality of shafts distributed at equal angular distances around the axis of rotation and extending axially parallel to the axis of rotation, on which a larger number of striking hammers are arranged freely swinging and spaced apart from one another. In its circumferential regions between the striking hammers, the rotor is generally equipped with so-called "protective caps" which, like the striking hammers, can be manufactured from steel, largely using casting technology, but alternatively also by forging, flame cutting or as weld construction. The protective caps arranged immediately adjacent to the striking hammers are in this case mounted spaced apart from the respective striking hammer such that, on the one hand, the striking hammer can freely perform its swing movement, but on the other hand the gap, which must necessarily be present between the respective protective cap and the assigned striking hammer, in order to enable its swing movement, is as narrow as possible in order to prevent, during operation, the ingress of metal or stone parts in the gap in question and prevent blocking of the hammer due to material sitting in the gap.

The centrifugal forces acting as a function of the respective revolution speeds in the case of the striking tools of the above-mentioned type mounted so as to rotate vertically or horizontally are high and lead to strong dynamic loads of the region of the bearing section which surrounds the bearing opening.

The bearing section and the striking section of striking tools of the type considered here must therefore fulfil completely different tasks, which essentially necessitate different mechanical properties. The striking section should have a hardness that is as great as possible in order to withstand the collisions, required for crushing, with the material to be respectively crushed with as little wear as possible. In contrast, the bearing section should have good toughness and associated with this good extension properties in order to be able to absorb the high dynamic loads, to which the striking tool is exposed during use due to its swing movement (centrifugal forces) and due to the collisions with the material to be crushed (impacts).

In order to set these different properties of its striking and bearing section, the striking tools go through a heat treatment after their forming, in whose course the required hardness is provided to the striking section and an optimized toughness is provided to the bearing section.

Practical experience shows that, in spite of this setting of the toughness of the bearing section of the striking tools that is tried and tested in practice, damage results due to excessive loads. Thus, cracks appear in the regions of the bearing section surrounding the bearing opening, which can lead to breakage.

Against the background of the previously explained prior art, the object therefore emerges to provide a striking tool, in which using simple means the ability of its bearing section to absorb the dynamic loads acting on the striking tool during use is further improved.

Moreover, a rotor should be provided for a machine to crush metal or stone materials, in which using simple means an optimally long durability of the striking tools mounted on it in a swinging manner is achieved.

SUMMARY OF THE INVENTION

A rotor solving the object mentioned above for a machine to crush metal or stone materials, in particular scrap, such as car bodies to be scraped, or stone debris originating from building construction or demolition is accordingly equipped with a striking tool according to the invention.

A striking tool according to the invention for crushing metal objects or stone materials is accordingly manufactured in line with the prior art explained at the outset from an iron-based material. The striking tool comprises a bearing section in which a bearing opening is formed for the freely swinging mounting of the striking tool around a pivot axis and a striking section which is exposed during use to a striking load by contact with the material to be crushed.

According to the invention, in the case of a striking tool of this type in new condition, the bearing opening now has a support section, on whose inner circumferential surface the striking tool is mounted in the case of its swing movement around the pivot axis and has an extension section which is connected to the support section and through which the bearing opening is extended in the direction of the striking section with respect to the support section.

In the case of a striking tool according to the invention, the bearing opening is, viewed in the cross-section normal to the pivot axis of the striking tool, no longer circular, as is usually the case with conventional striking hammers and comparable striking tools mounted so as to swing during use. In fact, the bearing opening is extended by the extension section in the direction of the striking section of the striking tool. As a result of this extension, the region of the bearing section surrounding the bearing opening is also extended. It has been shown that through this extension an effective increase in toughness of the region in question is achieved. Thus, in the case of a striking tool according to the invention, the dynamic loads occurring during use can be absorbed via a correspondingly enlarged region with the result that the proportional deformations, which the region in question must achieve, and associated therewith the tensions, which this region must absorb, are smaller than in the case of a conventionally formed striking tool. The danger of crack formation triggered by excessive tension or a breakage caused thereby of the region of the striking tool surrounding the bearing opening is therefore effectively counteracted.

In this case, it has proven particularly favorable for the extension of the bearing opening carried out according to the invention in the direction of the striking section of the striking tool to extend into a region of the striking tool which is loaded only slightly during practical use. Therefore, a weakening of the striking tool limiting the use in practice does not counteract the benefit achieved by the design of the bearing opening according to the invention in regards to the dynamic deformability of the bearing section.

Since, during use, the support section of the bearing opening is arranged with its inner circumferential surface on the side of the shaft opposite the striking section of the striking tool, on which the striking tool is mounted, the striking tool is held in contact on the shaft with the inner circumferential surface of the support section as a result of the centrifugal forces acting during use on the striking tool. The shape and extension of the bearing section can in this case be designed as a function of the pivot path travelled by the striking tool during use in the case of its swing movement such that the inner circumferential surface of the support section covers the entire surface of the shaft over which the striking tool rolls during the swing movement. To this end, the inner circumferential surface of the bearing opening can, in the region of the bearing section, have the shape of a cylindrical shell curved equally around the pivot axis of the striking tool, with the lateral boundary inner surfaces of the extension section being connected tangentially to the longitudinal edge, respectively assigned to them, of the inner circumferential surface of the bearing section in order to ensure a smooth transition to the inner circumferential surface of the support section. The radius of curvature of the cylindrical shell corresponds in this case expediently to the radius of a bearing opening circular in cross-section via which a conventionally-designed striking tool of the type belonging to the generic group of the invention is usually mounted on the shaft assigned to it.

A covering of the pivot region of the striking tool adequate for most cases of use emerges in this case when, viewed in a section transverse to the pivot axis of the striking tool, the inner circumferential surface of the support section of the bearing opening forming a cylindrical shell spans an angular range of at least 180° around the pivot axis.

The danger of a notch effect in the extension region of the bearing opening with simultaneously optimal tension distribution in the bearing section of the striking tool can be counteracted as the main inner surface of the extension section opposite the support section in the direction of the striking section is curved in the manner of a cylindrical shell, with an optimal load profile also emerging here in the material of the striking tool surrounding the bearing opening as a result of the main inner surface of the extension section being in each case connected tangentially to the lateral boundary inner surfaces of the extension section.

In particular in the case where the striking tool has in the region of the transition between its bearing section and its striking section a constricted portion, as is often the case with the striking hammers known from the prior art in order to achieve an optimal weight distribution between bearing section and striking section, it may be expedient to design the radius of the main inner surface of the extension section to be smaller than the radius of the inner circumferential surface of the support section. In the case of this configuration, the lateral boundary inner surfaces of the extension section proceeding from its main surface run in a V-shape in the direction of the respectively assigned longitudinal edge of the inner circumferential surface of the support section. In this way, a uniform thickness profile of the material, laterally surrounding the bearing opening, of the bearing section of the striking tool can be achieved which in turn contributes to the balance of the loads absorbed by the bearing section during use.

The lateral boundary inner surfaces of the extension section can essentially be formed flat, but also following the outer profile of the material of the bearing section surrounding the extension section.

A smaller radius of curvature of the main surface of the extension section has proven particularly expedient when the inner circumferential surface of the support section of the bearing opening is supposed to span an angular range of more than 180° in order to ensure a particularly secure mounting of the striking tool during use.

In other cases of use, it may be expedient when, viewed in a sectional plane aligned normal to the pivot axis of the striking tool, the radius of the main inner surface of the extension section is the same as the radius of the bearing section. In this case, the bearing opening is designed in the manner of an oval stretched in the direction of the striking section. In the case of this configuration, the striking tool therefore can be moved not only in a swinging manner, but also in a movement, which is aligned along its central middle axis aligned transverse to the pivot axis defined by the bearing opening, relative to the shaft on which it is mounted. In the case of a crushing machine, in which a rotor fitted with striking tools according to the invention rotates in a chamber, whose inner wall is arranged for an optimal crushing of the product to be crushed at a small distance from the free front end of the striking hammer rotating with the rotor, the danger can hereby be counteracted so that a striking tool is locks due to a material part such that it becomes stuck between rotor and inner wall. The striking tool, which is provided in the manner according to the invention explained here with an oval bearing opening designed in the manner of an elongated hole, can avoid such a blockage by displacing along its middle axis, i.e. transverse to the shaft on which it is mounted. In this case, the material part in question is generally conveyed out of its blockage position through the contact still taking place with the striking tool.

In the case where the inner circumferential surface of the support section and the main surface of the extension section are each curved with a uniform radius, it has been found to be favorable when, viewed in a sectional plane aligned normal to the pivot axis of the striking tool, the linear distance of the middle points of the curvature of the inner circumferential surface of the bearing section and the main inner surface of the extension section is at least 10 mm.

In particular when the striking tool, in relation to its central middle line, is designed symmetrically and the inner circumferential surface of the support section and the main surface of the extension section are each curved with a uniform radius, it is advantageous when, viewed in a sectional plane aligned normal to the pivot axis of the striking tool, the middle points of the curvature of the inner circumferential surface of the support section and the main inner surface of the extension section are at a distance from one another together on a central middle line of the striking tool aligned transverse to the longitudinal axis of the bearing opening.

Insofar as a striking tool is supposed to be supported not only on its side of the bearing eye remote from the striking section via the inner circumferential surface of the support section provided there, but also on the side of the bearing eye assigned to the striking section, this can thus be achieved with a striking tool according to the invention in that the extension section comprises at least two lower sections spaced apart in the circumferential direction of the bearing opening, which each extend in the direction of the striking section of the striking tool, with adjacent lower sections delimiting between them an additional support section of the striking tool. The additional support section is laterally separated from the material of the bearing section laterally surrounding the bearing opening by the lower sections of the extension section such that the effect, which is utilized according to the invention, of extending the region, which can be elongated with dynamic loading of the striking tool, also occurs when the additional support section supports the striking tool during use on the side of the bearing opening assigned to the striking section for its swing movement.

Typical steel materials, from which striking tools designed according to the invention are manufactured, quenched and tempered steels with carbon contents of 0.1 to 0.70% by weight which solidify martensitically and are already used for this purpose today.

Similarly, striking tools according to the invention can be manufactured from austenitically solidified steels with manganese contents of 7 to 30% by weight. These types of steel known under the name "Hadfield steels" have been proven in practice for manufacturing striking tools of the type in question here for many years. An example of such a Hadfield steel is the steel commercially available under the standard designation X120Mn12 and the material number 1.3401. Hadfield steels have a good wear resistance due to their high cold hardening ability precisely under impacting load.

Furthermore, striking tools according to the invention can be cast from iron cast materials known for this purpose, for example from so-called "white cast iron", which has chromium contents of up to 29% by weight.

BRIEF DESCRIPTION OF THE DRAWINGS

The invention is explained in more detail in the following with reference to a drawing representing an exemplary embodiment. The figures show schematically and not to scale.

DESCRIPTION OF THE INVENTION

Figure 1:
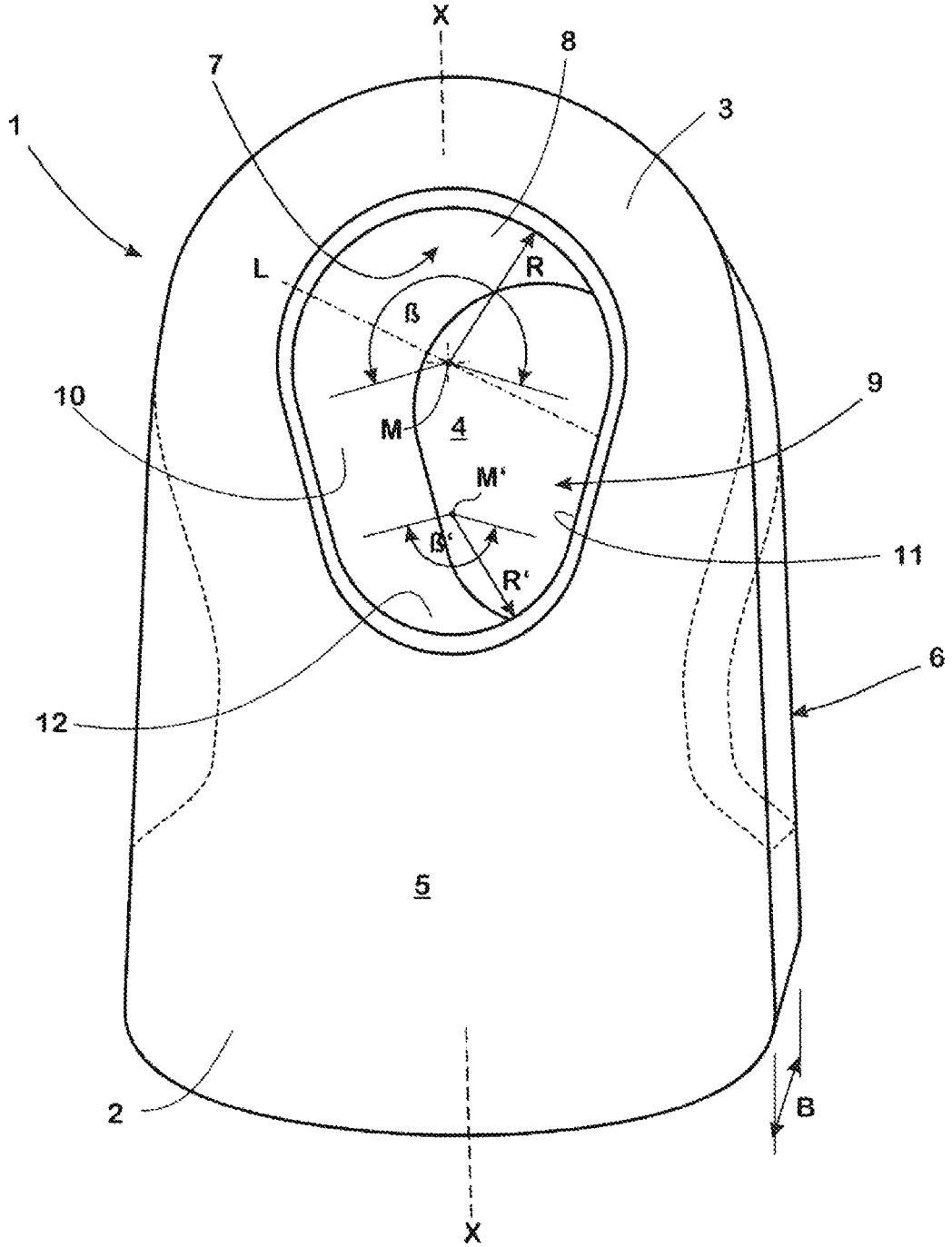
FIG. 1 a first striking tool in perspective view.
Figure 2:
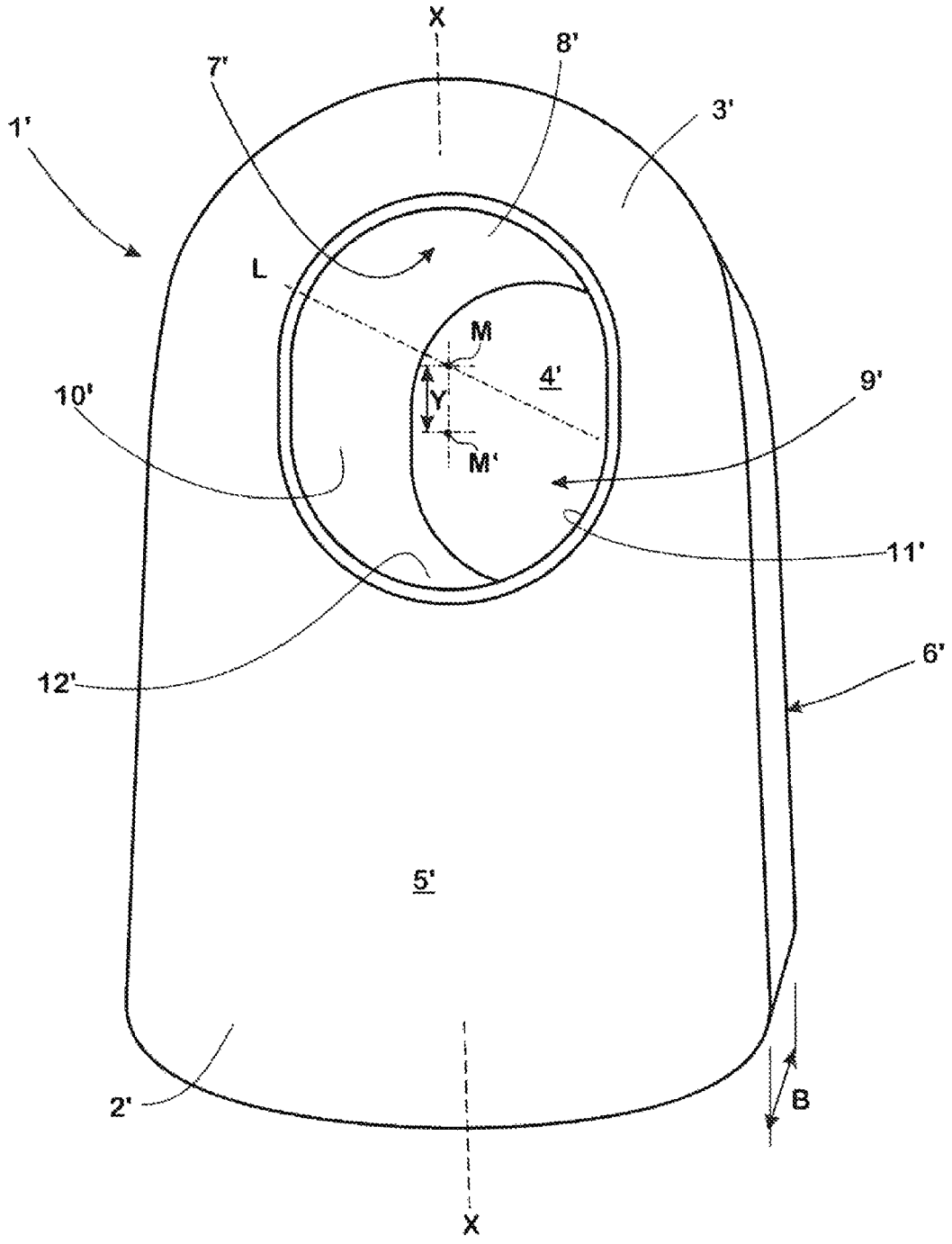
FIG. 2 a second striking tool in perspective view.
Figure 3:
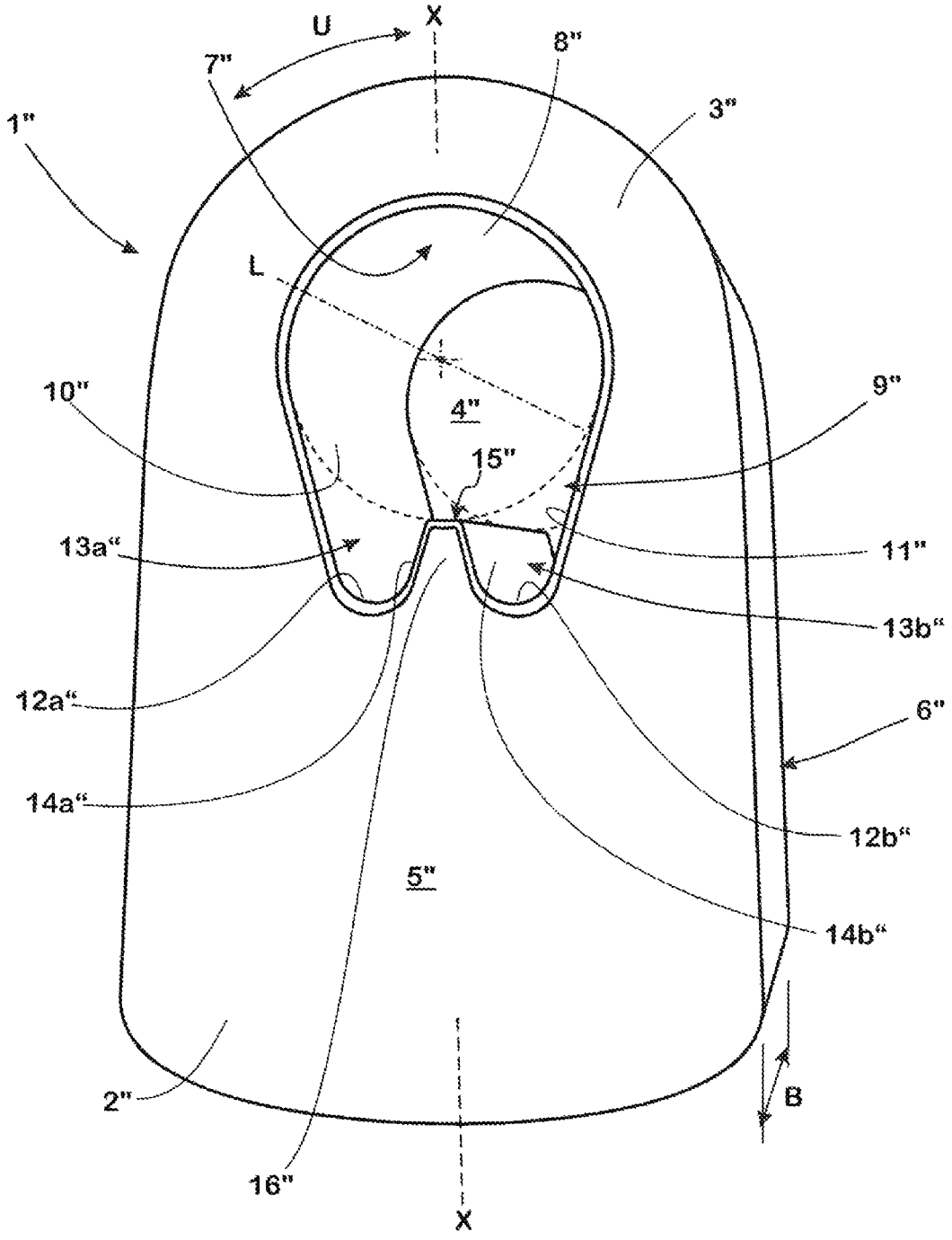
FIG. 3 a third striking tool in perspective view.

The striking tools 1, 1', 1" represented in FIGS. 1 to 3 serve as striking hammers for crushing metal scrap, such as vehicle bodies, mineral raw materials or mineral waste such as construction debris, overburden or the like.

To this end, the striking tools 1, 1', 1" are mounted on a conventional rotor not shown here in the manner so as to swing on a shaft of the rotor also not shown here. The manner of the swinging mounting of a striking tool, which belongs to the same generic group as a striking tool according to the invention, is for example described in EP 1 047 499 B1.

In order to fulfil its purpose, the striking tool 1, 1', 1" cast in a conventional manner in one piece for example from a Hadfield steel has a striking section 2, 2', 2" hardened by a suitable heat treatment in a manner also known per se, which comes into contact with the material to be crushed during practical use and as a result is exposed to extreme striking loads, and has a bearing section 3, 3', 3", which is heat treated in a similarly known manner such that it has a sufficient toughness and elongation properties, by means of which it is capable of absorbing the dynamic loads acting on the striking tool 1, 1', 1" during use.

A centrally arranged bearing opening 4, 4', 4" is formed into the bearing section 3, 3', 3" of the striking tools 1, 1', 1" which extends between the front ends 5, 5', 5"; 6, 6', 6" of the striking tool 1, 1', 1" over its width B. The central longitudinal axis L of the bearing opening 4, 4', 4" defines the swing axis around which the striking tool 1, 1', 1" swings during use around the shaft of the rotor generally also consisting of a steel material. In this case, there is metallic frictional contact between the shaft of the rotor and the striking tool 1, 1', 1".

In the case of the striking tool 1 represented in FIG. 1, the bearing opening 4 has on its side remote from the striking section 2 a support section 7 with an inner circumferential surface 8 curved uniformly in the manner of a cylindrical shell, which extends over the width B of the striking tool 1 and in this case spans an angular range ß of roughly 215°.

The bearing opening 4 is extended by an extension section 9 in the direction of the striking section 2. The flatly-designed lateral boundary inner surfaces 10, 11 of the extension section 9 are connected tangentially to the respectively assigned longitudinal edge of the inner circumferential surface 8 of the support section 7 and run in the direction of the striking section 2 towards one another until they meet the longitudinal edges, which are respectively assigned to them, of the main surface 12 of the extension section 9 assigned to the striking section 2 and also formed in the manner of a cylindrical shell. The main surface 12 also extends over the width B of the striking tool 1 and in this case spans an angular range ß' of approx. 145°. The radius R' of the curvature of the main surface 12 corresponds roughly to ¾ of the radius R of the curvature of the inner circumferential surface 8 of the support section 7, with the middle point M, M' of the curvatures of inner circumferential surface 8 and main surface 12 being located on a central middle axis X of the striking tool 1 aligned transverse to the longitudinal axis L of the bearing opening 4.

As illustrated in FIG. 1 by dashed lines, this forming of the bearing opening 4 is in particular advantageous when the striking tool 1 is constricted in the transition region between its bearing section 3 and its striking section 2. The lateral boundary inner surfaces 10, 11 can be formed such that they are aligned substantially parallel to the outer profile of the material of the bearing section 3 surrounding the bearing opening 4 and thus during use an optimal balance of the dynamic loads occurring in the bearing section 3 and the associated elongation is achieved.

In the case of the striking tool 1' represented in FIG. 2, the bearing opening 4' also has on its side remote from the striking section 2' a support section 7' with an inner circumferential surface 8' curved uniformly in the manner of a cylindrical shell, which extends over the width B of the striking tool. In this case, the inner circumferential surface 8' spans an angular range of 180°.

The bearing opening 4' is extended by an extension section 9' in the direction of the striking section 2'. The flat lateral boundary inner surfaces 10', 11' of the extension section 9' are aligned parallel to one another and are accordingly connected tangentially to the respectively assigned longitudinal edge of the inner circumferential surface 8' of the support section T and extend in the direction of the striking section 2' to the longitudinal edges, which are respectively assigned to them, of the main surface 12' of the extension section 9' assigned to the striking section 2' and also formed in the manner of a cylindrical shell. The main surface 12' also extends over the width B of the striking tool 1' and in this case spans an angular range ß' of similarly 180°. The radius of the curvature of the main surface 12' is the same as the radius of the curvature of the inner circumferential surface 8' of the support section 7'. In this case, the middle points of the curvatures of the inner circumferential surface 8' and the main surface 12' are at a distance Y to the central middle axis X. Corresponding to this distance, the striking tool 1' can be moved on the shaft, on which it is mounted in a swinging manner during use, additionally along the middle axis X in order to for example avoid trapped material.

In the case of the striking tool 1" represented in FIG. 3, the bearing opening 4" in turn has on its side remote from the striking section 2" a support section 7" with an inner circumferential surface 8" curved uniformly in the manner of a cylindrical shell, which extends over the width B of the striking tool 1" and in this case, like the inner circumferential surface 8 in the striking tool 1, spans an angular range ß of roughly 215°.

The bearing opening 4" is extended by an extension section 9" in the direction of the striking section 2". The flatly-designed lateral boundary inner surfaces 10", 11" of the extension section 9" are connected tangentially to the respectively assigned longitudinal edge of the inner circumferential surface 8" of the support section 7" and run, similarly to the striking tool 1, in the direction of the striking section 2" towards one another until they meet the longitudinal edges, which are respectively assigned to them, of the main surfaces **12*a*", 12*b*" of lower sections 13*a*", 13*b*" of the extension section 9" respectively assigned to the striking section 2" and also formed in the manner of a cylindrical shell. The main surfaces 12*a*", 12*b*" also each extend over the width B of the striking tool 1 and span an angular range ß' of approx. 145°. The radius R' of the curvature of the main surfaces 12*a*", 12*b*" corresponds roughly to 40% of the radius R of the curvature of the inner circumferential surface 8 of the support section 7**.

The lower sections **13*a*", 13*b*" of the extension section 9" are aligned spaced in the circumferential direction and symmetrically to the central middle axis X. In this case, their main surface 12*a*", 12*b*" on their longitudinal edge facing away from the respectively assigned boundary inner surface 10", 11" merges in each case into a flat boundary surface 14*a*", 14*b*". Proceeding from the main surface 12*a*", 12*b*" assigned to it in each case, the boundary surfaces run towards one another until they meet the upper support surface 15" of a support section 16" separating the lower sections 13*a*" 13*b*"** from one another.

The support surface 15" is also curved in the manner of a cylindrical shell and extends over the width B of the striking tool 1". In this case, the support surface 15" is located on the cylindrical surface illustrated in FIG. 3 by dashed lines, on which the inner circumferential surface 8" of the support section 7" of the bearing opening 4" is also located. In this way, the support section 16" with its support surface 15" also supports the striking tool 1" during use on the side of the bearing opening 4" assigned to the striking section 2" against the shaft on which the striking tool 1" is mounted in a swinging manner. At the same time, the lower sections **13*a*", 13*b*" separate the support section 16" from the material surrounding the bearing opening 4" such that, in spite of the presence of the additional support section 16", the same positive effects in regards to the durability and increase in useful life occur, as in the case of the configurations of the striking tools 1, 1', 1" represented in FIGS. 1 and 2**.

As illustrated in FIG. 3 by dashed lines, this forming of the bearing opening 4 is in particular advantageous when the striking tool 1 is constricted in the transition region between its bearing section 3 and its striking section 2. The lateral boundary inner surfaces 10, 11 can be formed such that they are aligned substantially parallel to the outer profile of the material of the bearing section 3 surrounding the bearing opening 4 and thus during use an optimal balance of the dynamic loads occurring in the bearing section 3 and the associated elongation is achieved.

REFERENCE NUMERALS

1,1',1" striking tools
2,2',2" striking sections of the striking tools 1,1',1"
3,3',3" bearing sections
4,4',4" bearing openings
5,5',5" first front ends of the striking tools 1,1',1"
6,6',6" second front ends of the striking tools 1,1',1"
7,7',7" support sections of the bearing openings 4,4'4"
8,8',8" inner circumferential surfaces of the support sections 7,7',7"
9,9',9" extension sections
10,10',10" boundary inner surfaces of the extension sections 9,9',9"
11,11',11" boundary inner surfaces of the extension sections 9,9',9"
12,12' main surfaces of the extension sections 9,9',9"
**12*a*",12*b*" main surfaces of the lower sections 13*a*",13*b*"**
**13*a*",13*b*"** lower sections
**14*a*",14*b*"** boundary surfaces
15" support surface of the support section 16"
16" additional support section
ß,ß' angular ranges
B width of the striking tools 1,1',1"
L longitudinal axis of the bearing openings 4,4',4"
M,M' middle points of the curvature of the inner circumferential surfaces 8,8',8"
R,R' radii of curvature
X middle axis X of the striking tools 1,1',1"
Y distance

The invention claimed is:

1. A striking tool for crushing metal objects or stone materials, comprising:

a bearing section, into which a bearing opening is formed for the freely swinging mounting of the striking tool around a pivot axis;

a striking section, which during use is exposed to a striking load by contact with the material to be crushed, and wherein the striking tool and the bearing opening have a support section, on whose inner circumferential surface the striking tool is mounted to swing around the pivot axis and have an extension section which is connected to the support section and by means of which the bearing opening is extended in the direction of the striking section with respect to the support section, wherein the extension section comprises at least two lower sections spaced apart in the circumferential direction of the bearing opening, which each extend in the direction of the striking section of the striking tool and in that adjacent lower sections each delimit between them a further support section of the striking tool which supports the striking tool during use on a side of the bearing opening assigned to the striking section for its swing movement and wherein the striking tool is manufactured from an iron-based material.

2. The striking tool according to claim 1, wherein the inner circumferential surface of the support section of the bearing opening has a shape of a cylindrical shell and in that a lateral boundary inner surfaces of the extension section are connected tangentially to a longitudinal edge, which is respectively assigned to the bearing opening, of the inner circumferential surface of the support section.

3. The striking tool according to claim 2, wherein, viewed in a section transverse to the pivot axis of the striking tool, the support section spans an angular range of at least 180° around the pivot axis.

4. The striking tool according to claim 3, wherein a main surface of the extension section opposite the support section in the direction of the striking section is curved in the manner of a cylindrical shell.

5. The striking tool according to claim 3, wherein the main inner surface of the extension section is in each case connected tangentially to the lateral boundary inner surfaces of the extension section.

6. The striking tool according to claim 4, wherein when viewed in a sectional plane aligned normal to the pivot axis of the striking tool, a radius of the main inner surface of the extension section is smaller than a radius of the inner circumferential surface of the support section.

7. The striking tool according to claim 4, wherein when viewed in a sectional plane aligned normal to the pivot axis of the striking tool, the radius of the main inner surface of the extension section is the same as a radius of the support section.

8. The striking tool according to claim 4, wherein when viewed in a sectional plane aligned normal to the pivot axis of the striking tool, the linear distance of a plurality of middle points of the curvature of the inner circumferential surface of the support section and of the main inner surface of the extension section is at least 10 mm.

9. The striking tool according to claim 4, wherein when viewed in a sectional plane aligned normal to the pivot axis of the striking tool, the middle points of the curvature of the inner circumferential surface of the support section and of the main inner surface of the extension section are located at a distance from one another together on a central middle axis of the striking tool aligned transverse to the longitudinal axis of the bearing opening.

10. The striking tool according to claim 1, wherein the striking tool consists of an iron or steel cast material.

11. A rotor for a machine for crushing metal objects or stone materials, comprising at least one metallic shaft, on which at least one striking tool formed according to claim 1 is mounted with the bearing open.

* * * * *